United States Patent [19]

Harp, Jr.

[11] 3,961,484

[45] June 8, 1976

[54] INTERNAL COMBUSTION ENGINE WITH POWER RECOVERY TURBINE

[76] Inventor: James L. Harp, Jr., 8435 Cozycroft, Canoga Park, Calif. 91306

[22] Filed: July 29, 1974

[21] Appl. No.: 492,606

[52] U.S. Cl. ..... 60/624; 123/119 C; 60/598

[51] Int. Cl.[2] ..... F02G 3/02

[58] Field of Search ..... 60/624, 620, 597, 598; 123/119 C, 119 CG

[56] References Cited

UNITED STATES PATENTS

| | | | |
|---|---|---|---|
| 1,308,373 | 7/1919 | Rombach | 60/624 |
| 1,933,612 | 11/1933 | Woolson | 123/119 CG |
| 2,406,656 | 8/1946 | Birmann | 60/614 |
| 3,064,417 | 11/1962 | Tryhorn et al. | 60/597 |
| 3,153,318 | 10/1964 | Tryhorn et al. | 60/598 |
| 3,221,492 | 12/1965 | Carletti | 60/280 |
| 3,473,322 | 10/1969 | Wolf | 60/607 |

*Primary Examiner*—Charles J. Myhre
*Assistant Examiner*—William C. Anderson
*Attorney, Agent, or Firm*—Ralph B. Pastoriza

[57] ABSTRACT

Greater overall power is obtained from an internal combustion engine utilizing a power recovery turbine operated by the exhaust gases from the engine cylinders by dimensioning the stacks connecting the exhaust valve flow areas to the turbine such that each stack has a cross sectional flow area less than the cross sectional flow area of the exhaust valve when fully opened. While there results a slight increase in frictional losses in the stack and pumping losses to the piston, such losses are more than made up by the substantial decreases in throttling losses across the exhaust valve flow area during the valve opening process.

1 Claim, 4 Drawing Figures

INTERNAL COMBUSTION ENGINE WITH POWER RECOVERY TURBINE

The invention herein described was made in the course of and/or under a contract with the U.S. Army Tank-Automotive Command, Department of the Army.

This invention relates generally to power plants and more particularly to improved internal combustion engines utilizing power recovery turbines.

BACKGROUND OF THE INVENTION

It is well known and has been shown by many investigators in the past that there is a significant amount of wasted energy in the exhaust gases of internal combustion engines. These losses result from the fact that each piston in its associated cylinder reaches the bottom of its power stroke before the hot combustion gases are fully expanded to ambient pressure. In order to recover an appreciable amount of this wasted energy, the exhaust gases must be expanded to a very large volume. The most practical manner of achieving such further expansion is to pass the gases through a turbine. The turbine, in turn, is drivably connected to a turbocharger for the engine and/or to the engine crankshaft.

U.S. Pat. Nos. 2,607,189 and 2,625,006, assigned to the Curtis-Wright Corporation disclose such a combination internal combustion engine and power recovery turbine and the devices described have proved enormously successful in aircraft operation. However, even with the engine turbine combination, it has been found that about forty per cent of the available energy in the gases passed to the turbine is lost before reaching the turbine. Most of the losses are the result of throttling losses (sometimes called "dump losses" or "wire drawing losses") across the exhaust valve flow areas during the valve opening process.

In the U.S. Army's 525 CID VHO six cylinder diesel engine, at rated speed and power, the pressure in the cylinder at the instant that the exhaust valve starts to open (crank angle of 118° from TDC) is 444 inches of mercury absolute. The temperature in the cylinder at that instant is 1827°F. Also at that instant, the pressure in the exhaust stack just downstream of the exhaust valve is about 99 inches of mercury absolute as a result of exhaust from other cylinders. Therefore, just after the exhaust valve starts to open, the high pressure gases in the cylinder start to bleed into the exhaust stack which is at a much lower pressure. There is a significant loss in total pressure and available energy during this opening process.

Ideally, it would be desirable to have the exhaust valves open instantaneously which would eliminate all dump losses. However, in practice this is not possible. In most engines operating at rated speed, the exhaust valves already open as fast as stresses will permit. Accordingly, some other solution to reduce dump losses is needed.

In a publication entitled THE BROWN BOVERI REVIEW, dated November, 1950, pp. 433–439, there is discussed in considerable detail the foregoing problem of lost energy in the exhaust gases prior to reaching a power recovery turbine in an internal combustion engine - turbine combination. In this discussion as well as in the aforementioned patents, it has been the practice to make the exhaust stacks or conduits connecting the exhaust valve flow areas to the turbine of greater internal cross sectional flow area than the actual cross sectional flow area of the exhaust valve when in opened position. The latter mentioned publication goes into substantial detail with respect to dimensioning of these exhaust stacks and concludes that the cross sectional area should not be substantially greater than the fully opened exhaust valve passage, but rather of the order of about 1.20 times the exhaust valve passage. Apparently, the primary considerations in past constructions was to utilize an exhaust stack size greater than the area of the exhaust valve when open in order to reduce the back pressure on the piston during the exhaust stroke to provide maximum reciprocating engine horsepower.

BRIEF DESCRIPTION OF THE PRESENT INVENTION

With the foregoing in mind, the present invention constitutes a new discovery with respect to internal combustion - turbine recovery engines which provides for even greater power recovery than has been possible in the prior art developments discussed above. More particularly, the present invention provides an arrangement whereby the throttling losses across the exhaust valve flow area can be substantially reduced beyond that heretofore possible thereby enabling greater utilization of the energy in the exhaust gases for driving the turbine.

More particularly, in accord with the invention, for given inlet and exhaust valve flow areas, in a combination internal combustion engine and recovery turbine, the stacks connecting the exhaust valve flow areas to the turbine are each dimensioned to have a cross sectional flow area less than the given cross sectional flow area of the exhaust valve to which it is connected. While so decreasing the cross sectional area of the stack relative to the valve area results in a slight increase in friction loss in the stack, and pumping losses to the piston, there is surprising reduction in valve throttling losses.

The reason for this reduction in throttling losses is that the fill time necessary for the pressure in the stack to approach the pressure in the cylinder is reduced significantly as the stack area (and volume) is reduced. In otherwords, it has been determined that the throttling losses across the exhaust valve when the stack area is larger than the exhaust valve opening is far more detrimental to total power output than the increased piston pumping due to increased back pressure when the exhaust stack area is less than the maximum exhaust valve opening.

BRIEF DESCRIPTION OF THE DRAWINGS

A better understanding of the invention will be had by referring to the accompanying drawings in which.

DETAILED DESCRIPTION OF THE INVENTION

Figure 1:
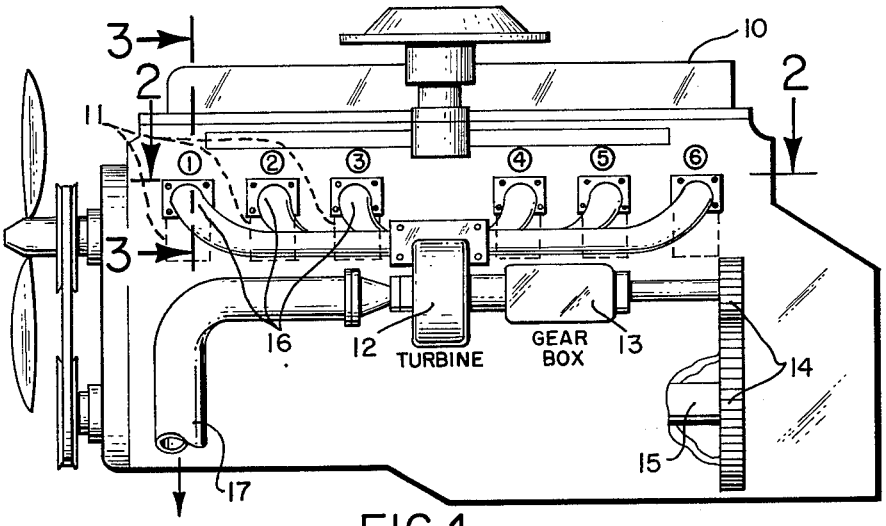
FIG. 1 is a side elevational view of an internal combustion engine with a power recovery turbine incorporating the improvements of the present invention.

Referring first to FIG. 1, there is shown a six-cylinder internal combustion engine 10, the cylinders being indicated by the dashed lines 11 and numbered 1–6. Exhaust gases from the cylinders are passed to a power recovery turbine 12 coupled through a reduction gear box 13 and gears 14 to the engine crankshaft 15. The normal firing order on six cylinder engines is 1-5-3-6-2-4. In order to prevent adverse effects on volumetric efficiency and piston pumping losses, it is necessary to keep the exhaust flow from cylinders 1, 2 and 3 separate from the exhaust flow of cylinders 4, 5 and 6 until the exhaust flow enters the turbine 12.

In accord with the present invention, there are provided stacks 16 connecting the exhaust valve flow areas to the turbine, each stack having substantially the same, constant cross sectional flow area, which area is less than the cross sectional flow area of the exhaust valve to which it is connected.

Figure 2:
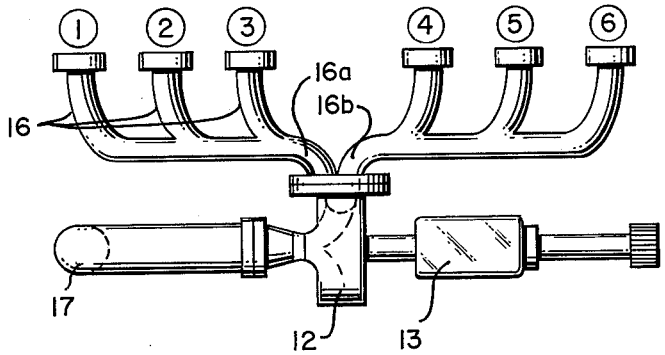
FIG. 2 is a plan view of the exhaust stacks and turbine taken in the direction of arrows 2—2 of FIG. 1.

As illustrated, in FIG. 2, the stacks 16 for cylinders 2 and 3 connect with the end 16*a* of the stack for cylinder 1 which in turn connects with the turbine inlet. Since the exhaust valves for cylinders 1, 2 and 3 are opened at different times, the exhaust pressure pulse from one cylinder does not substantially influence the pressure pulse from the other two cylinders. The same holds true for the cylinders 4, 5 and 6 in end 16*b*.

Figure 3:
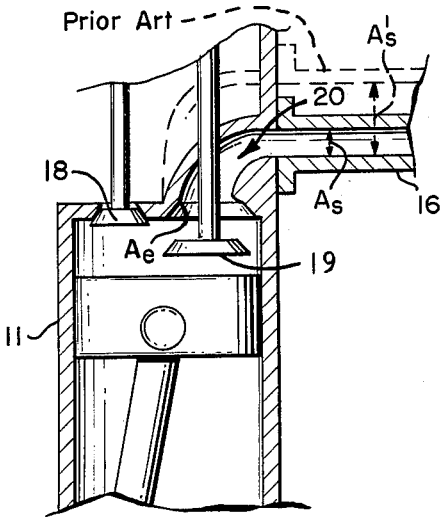
FIG. 3 is a fragmentary cross section, partly diagramatic in form, taken in the direction of the arrows 3—3 of FIG. 1; and, FIG. 4 shows bar graphs comparing power gains for a turbocharged diesel engine realizable by the present invention with a prior art turbocharged diesel engine.

The foregoing will become clearer by referring to FIG. 3 illustrating a typical one of the cylinders 11 partially in cross section. In FIG. 3, the cylinder head incorporates an inlet valve 18 and exhaust valve 19 cooperating with an exhaust valve opening to define a given exhaust valve flow area A*e* when the exhaust valve 19 is in open position as shown. The exhaust stack 16 for cylinder 1 is connected to the valve opening by a port passage 20 which has an area A*e* at the inlet of the port passage and decreases to the area of the stack $A_s$ immediately downstream of the valve stem. Also in FIG. 3, there is depicted by the dashed lines the typical prior art dimensioning of the port passage and exhaust stack cross sectional flow area as at $A_s'$.

Extensive research and experiments on the Army VHO Diesel engine have shown that when the stack area $A_s$ was 0.75 of the exhaust valve cross sectional flow area A*e*, the throttling losses across the exhaust valve during the opening process were optimized when increased pumping losses were taken into consideration so that maximum engine total output results. The stack area $A_s$ could vary between 0.50 and 0.90 of the exhaust valve flow area A*e* for maximum total engine output depending upon engine construction, operating characteristics, and power settings. In the prior art or conventional stacks wherein the exhaust stack area is from 1.20 to 2.00 times the exhaust valve flow area A*e*, it has been calculated that about 40 percent of the available energy in the exhaust gases in the cylinder is lost before reaching the turbine. The decreased dimensioning of the stacks in accord with the present invention cuts these losses from about forty percent to about fifteen percent. Thus, by dimensioning all of the various stacks as shown in FIG. 1 with a decreased cross sectional area as described, more recovery power from the turbine to the engine is available.

Figure 4:
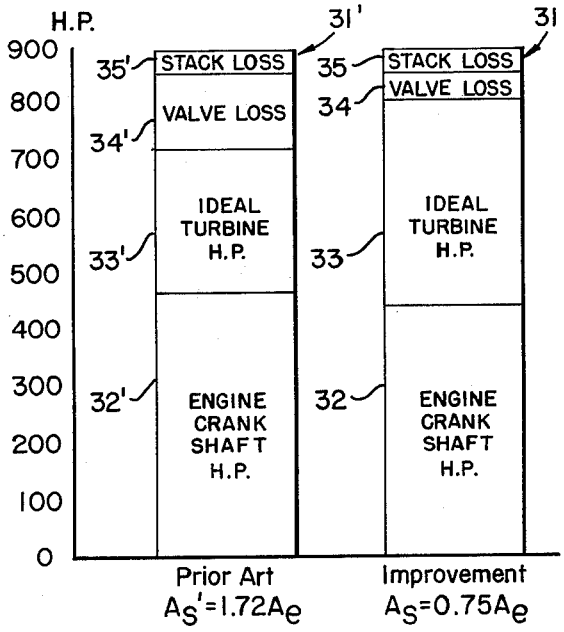

Referring now to FIG. 4, there is graphically illustrated the improved power realizable for turbocharged diesel engines such as the Army VHO in accord with the present invention. The bar graph to the right designated 31 illustrates the power available from the improved engine of the present invention as compared to the bar graph 31′ showing the power available from the engine before incorporating the invention therein. In the particular example illustrated, the improved engine utilized a stack cross sectional flow area of 0.75 times the exhaust valve cross sectional flow area for comparison with the prior art engine wherein the stack cross sectional area was 1.72 times the exhaust valve cross sectional flow area.

Comparing these plots, it will be noted that the engine crank shaft horsepower for the improved engine is slightly less than the prior art engine shown at 32 and 32′ because of increased piston pumping loss resulting from the small stack area. The ideal turbine horsepower (ideal turbine horsepower is defined as the horsepower which would be obtained if the exhaust gases were expanded isotropically to atmospheric pressure through a 100 percent efficient turbine) developed is substantially greater in the improved engine as indicated at 33 over the turbine horsepower of the prior art engine indicated at 33′ so that the total available output power of the engine-turbine combination constituting the total of 32 and 33 for the new engine is substantially greater than the total 32′ plus 33′ of the prior art engine. This increased ideal turbine horsepower is a result of the substantial reduction in valve loss as indicated at 34 in FIG. 4 as compared to the valve loss 34′ in the prior art engine. There will be a very slight increase in stack losses as indicated at 35 for the improved engine as compared to 35′ for the prior art engine but as is evident from these plots, such increased losses in the stack are more than made up by the greater turbine horsepower developed. Experimental tests with the Army VHO Diesel engine indicate that the present invention will permit both an increase in maximum total power output and an increase in fuel economy on the order of 20 to 30 percent.

From the foregoing description, it will thus be evident that the present invention has provided a substantial improvement in the operating characteristics of internal combustion engines utilizing power recovery turbines. This invention is applicable to both Diesel and Otto cycle engines.

What is claimed is:

1. In combination: an internal combustion engine having cylinders with given inlet and exhaust valve flow areas; a turbine coupled to the engine wherein exhaust gases are passed to said turbine to provide recovery power derived from said exhaust gases; stacks connecting the exhaust valve flow areas to said turbine; each stack having a cross sectional flow area less than the given cross sectional flow area of the exhaust valve to which it is connected; and a port for each cylinder connecting the associated exhaust stack to the exhaust outlet, said port reducing in cross sectional area between said outlet and said stack, the cross sectional flow area of each of said stacks being from 0.50 to 0.90 the given cross sectional flow area of the exhaust valve to which it is connected, said reduced stack areas permitting a quicker buildup of high pulse pressure in the stack thereby reducing throttling losses during the valve opening process.

* * * * *